US006929232B1

(12) United States Patent
Gasperi et al.

(10) Patent No.: US 6,929,232 B1
(45) Date of Patent: Aug. 16, 2005

(54) MAGNETIC SOAP HOLDER

(75) Inventors: Nancy R. Gasperi, Racine, WI (US); Michael L. Gasperi, Racine, WI (US); Steven S. Cascio, Kenosha, WI (US)

(73) Assignee: Noveletti, LLC, Centennial, CO (US)

( * ) Notice: Subject to any disclaimer, the term of this patent is extended or adjusted under 35 U.S.C. 154(b) by 0 days.

(21) Appl. No.: 10/193,618

(22) Filed: Jul. 10, 2002

Related U.S. Application Data

(60) Provisional application No. 60/304,132, filed on Jul. 10, 2001.

(51) Int. Cl.[7] ..... A47G 29/00; F16M 11/00
(52) U.S. Cl. ..... 248/683; 248/206.5; 248/309.4
(58) Field of Search ..... 248/683, 206.5, 248/309.4

(56) References Cited

U.S. PATENT DOCUMENTS

| | | | | |
|---|---|---|---|---|
| 2,597,925 A | | 5/1952 | Edger | |
| 2,825,177 A | | 3/1958 | Nordlof et al. | |
| 3,169,743 A | | 2/1965 | Page, Jr. | |
| 3,289,990 A | | 12/1966 | Grantham | |
| 3,472,391 A | | 10/1969 | Bolognesi | |
| 3,552,705 A | * | 1/1971 | Caster | 248/309.4 |
| D249,207 S | | 9/1978 | Emmer | |
| D253,147 S | | 10/1979 | Heckler | |
| D253,148 S | | 10/1979 | Heckler | |
| D253,149 S | | 10/1979 | Heckler | |
| 4,207,975 A | | 6/1980 | Arzillo | |
| D277,820 S | | 3/1985 | Maayeh | |
| 4,861,505 A | | 8/1989 | Farman | |
| D341,049 S | | 11/1993 | Hugh | |
| 5,368,268 A | | 11/1994 | Jodwischant | |
| 5,417,397 A | | 5/1995 | Harnett | |
| D365,235 S | | 12/1995 | Jodwischat | |
| D375,219 S | | 11/1996 | Selent | |
| 5,642,871 A | | 7/1997 | Repert et al. | |
| D402,146 S | * | 12/1998 | Moosavi et al. | D6/538 |
| 5,947,439 A | | 9/1999 | Florey | |
| D458,493 S | | 6/2002 | Cascio | |
| D458,494 S | | 6/2002 | Cascio | |

* cited by examiner

*Primary Examiner*—Leslie A. Braun
*Assistant Examiner*—Amy J. Sterling
(74) *Attorney, Agent, or Firm*—Godfrey & Kahn, S.C.

(57) ABSTRACT

A magnetic soap holder comprising a substantially vertical portion and a substantially horizontal portion. The vertical portion being horizontally mountable to a flat surface and extending upwardly and outwardly from a base. The horizontal portion extends upwardly and outwardly from the vertical portion and includes a horizontal end portion. The horizontal end portion having a top surface and a flat bottom surface. A magnet is attached to the bottom surface for magnetically attracting a magnetic member pressed into a bar of soap, thereby suspending the bar of soap above a tub or sink basin. The structure, geometry and design of the present invention facilitates better materials of construction for the magnetic soap holder, improving quality and overall appearance of the soap holder, as well as increased height of the magnetic soap holder, improving the utility of the soap holder.

10 Claims, 9 Drawing Sheets

MAGNETIC SOAP HOLDER

CROSS-REFERENCE TO RELATED APPLICATION

This application is based on and claims priority from U.S. Provisional Application Ser. No. 60/304,132, filed Jul. 10, 2001.

BACKGROUND OF THE INVENTION

This invention relates to magnetic soap holders, specifically to such holders that are magnetic memorable of suspending soap over a sink basin.

Soap dishes are simple solutions for holding a bar of soap between uses. Soap lying in a dish or a holder on the edge of a sink with excess water from washing causes the soap to continue to dissolve reducing the useful life of the soap and leaving a coating on the dish or holder that requires periodic cleaning. Soap supporting features in soap dishes help, but they still get messy and require cleaning. Magnetic soap holders, like the present invention, were invented to solve this problem.

The concept of a magnetic soap holder has been around at least since at least 1947 when U. W. Edger invented a wall-mounted soap holder as shown in U.S. Pat. No. 2,597,925. A bar of soap is suspended from a magnet in the soap holder by a metallic anchor embedded into the bar of soap. Since that time many variations and improvements to the wall-mounted arrangement have been developed. Many design patents have been granted for wall-mounted magnetic soap holders as well.

Wall-mounting a magnetic soap holder with the base positioned vertically on the wall is far from optimal. For one thing, the location of the soap is not convenient to the faucet controls. Drips of excess soapy water falling from the soap and/or hands after washing may soil counter tops or other surfaces near the wall. Replacement of the soap after use requires dexterity so that the user's hand or the soap does not contact the wall. Generally, the soap holder weight must be kept to a minimum and lightweight products are often associated with low value products.

Another magnetic soap holder is shown in U.S. Pat. No. 3,169,743 to J. S. Page, Jr. This patent describes a small plastic magnetic soap holder that can be horizontally mounted or vertically mounted to a wall. The holder positions the soap at an angle on the edge of the sink basin or on a wall near the sink. The holder is short and mounts entirely below the center of gravity of the soap. Again, although some of the drips from excess soapy water may land in the sink basin, a portion of the soapy residue must run down the sides of the holder and onto surfaces near the near the holder soiling both the holder and surfaces near the holder. Also, replacement of the soap after use may be difficult with his design since the bar of soap blocks the view of the holder.

Totally freestanding magnetic soap holding pedestals have also been designed. An example is shown in U.S. Pat. No. D249,207 to Emmer. A totally freestanding design requires substantial mounting bases to overcome the weight of the suspended bar of soap and the forces exerted by people removing and replacing the soap on the pedestal. Many sinks and tubs do not have sufficient edge width or counter tops to accommodate these designs. The base of these designs also interferes with positioning the bar of soap over the sink basin.

U.S. Pat. No. D277,820 to Maayeh, shows a design for a magnetic soap holder that can be either vertically wall-mounted or horizontally mounted. A product that employed this design is sold by Uniplast, Incorporated of Grand Prairie, Tex. under the trademark MAGNA-HOLD™. The MAGNA-HOLD™ soap holder is fabricated from lightweight injection molded plastic and uses double-sided foam tape for attachment to a vertical wall or horizontal surface. When affixed to a horizontal surface, the Maayeh holder elevates the soap to an insufficient height to overcome the edge or lip on drop-in style sinks. The center of gravity of the Maayeh soap holder is located well past the front of the base, which caused the holder to be totally dependent on the adhesive for support. Initial trial placement of the soap holder is also impossible, due to the single usage adhesive, as the holder would topple over into the sink. Making the holder from higher quality materials would tend to increase the weight of the holder and exacerbating its dependence on the adhesive.

Accordingly, there is a need for an improved magnetic soap holder made from higher quality materials that is attachable to the counter top or edge of a sink and positions a bar of soap well above the edge or lip of the sink and extends the soap well into the sink basin, such that any soapy water residue from the soap falls into the sink basin.

SUMMARY OF THE INVENTION

Allows the soap holder to be freestanding (without soap) facilitating its placement on the sink as well as display in stores and the like.

The structure, geometry and design of the present invention facilitates better materials of construction for the magnetic soap holder, improving quality and overall appearance of the soap holder, as well as increased height of the magnetic soap holder, improving the utility of the soap holder.

Added height and depth allow magnetic soap holder to extend further over the sink and well above the lip of the sink. The horizontal end portion extends fully over the sink. The magnetic soap holder of the present invention is completely balanced and freestanding when a bar of soap is not attached to the holder.

Various other features, objects, and advantages of the invention will be made apparent to those skilled in the art from the following detailed description, claims, and accompanying drawings.

DETAILED DESCRIPTION OF THE INVENTION

Figure 1:
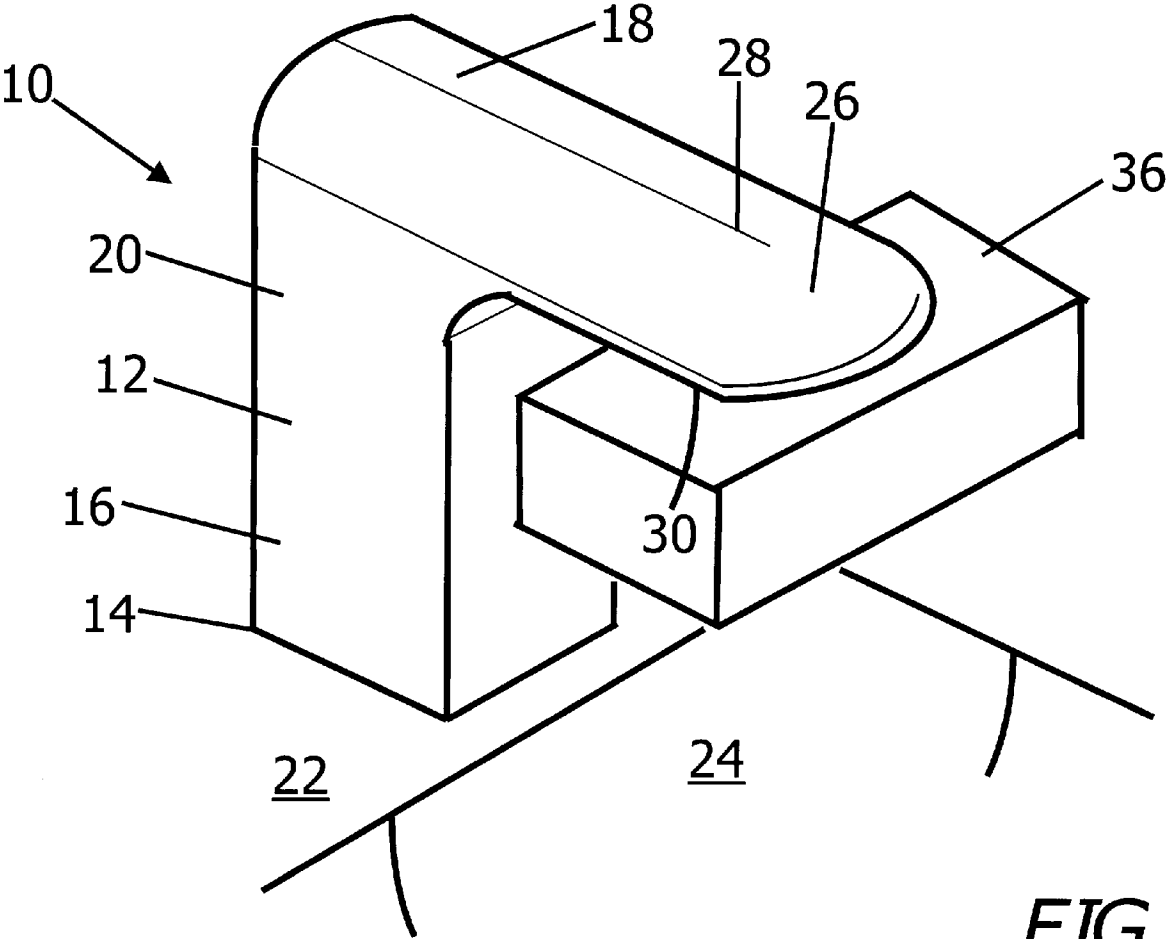
FIG. 1 is a perspective view of a magnetic soap holder mounted next to a sink in accordance with a preferred embodiment of the present invention.

Referring now to the drawings, FIG. 1 illustrates a preferred embodiment of a magnetic soap holder 10 according to the present invention. The magnetic soap holder 10 comprises a substantially vertical portion 12 extending upwardly from a base 14 on one end 16 thereof and a substantially horizontal portion 18 extending upwardly and outwardly from the other end 20 of the substantially vertical portion 12 opposite the base 14. The substantially horizontal portion 18 includes a horizontal end portion 26 having a top surface 28 and a bottom surface 30, the horizontal end portion 26 extending outwardly from the vertical portion 12 of the holder.

The horizontal end portion 26 preferably includes a magnet 32 attached to the bottom surface 30 of the horizontal end portion 26 for magnetically attracting a magnetic member 34 that is pressed into a bar of soap 36 to be suspended from the horizontal end portion 26 of the magnetic soap holder. The magnetic member 34 is preferably embedded within the bar of soap 36 and is attracted to the magnet 32 attached to the bottom surface 30 of the horizontal end portion 26.

As shown in FIG. 1, the magnetic soap holder 10 is preferably installed on a horizontal surface 22 in a convenient location around the edge of a sink 24. A bar of soap 36 is shown attached to the magnetic soap holder 10. The bar of soap 36 attached to the magnetic soap holder 10 is suspended entirely over the basin of the sink 24. This allows any excess water left on the bar of soap after use to drip directly into the sink basin.

The magnetic soap holder is preferably made from a rigid water proof material, such as plastic, metal, wood, ceramic, glass, granite, cement, stone, rock, CORIAN® and cast resin. For example, the magnetic soap holder may be made from hollow porcelain ceramic, which makes it strong. After glazing, it has a surface that is both durable and water repellent. Even when cast into a hollow form, the resulting structure has a weight comparable to the bar of soap. It can be molded into creative shapes like animal heads to make the soap holder both functional and attractive. The magnetic soap holder may be constructed from an integral single piece of material or may be constructed of more than one piece of material that are attached together.

Figure 2:
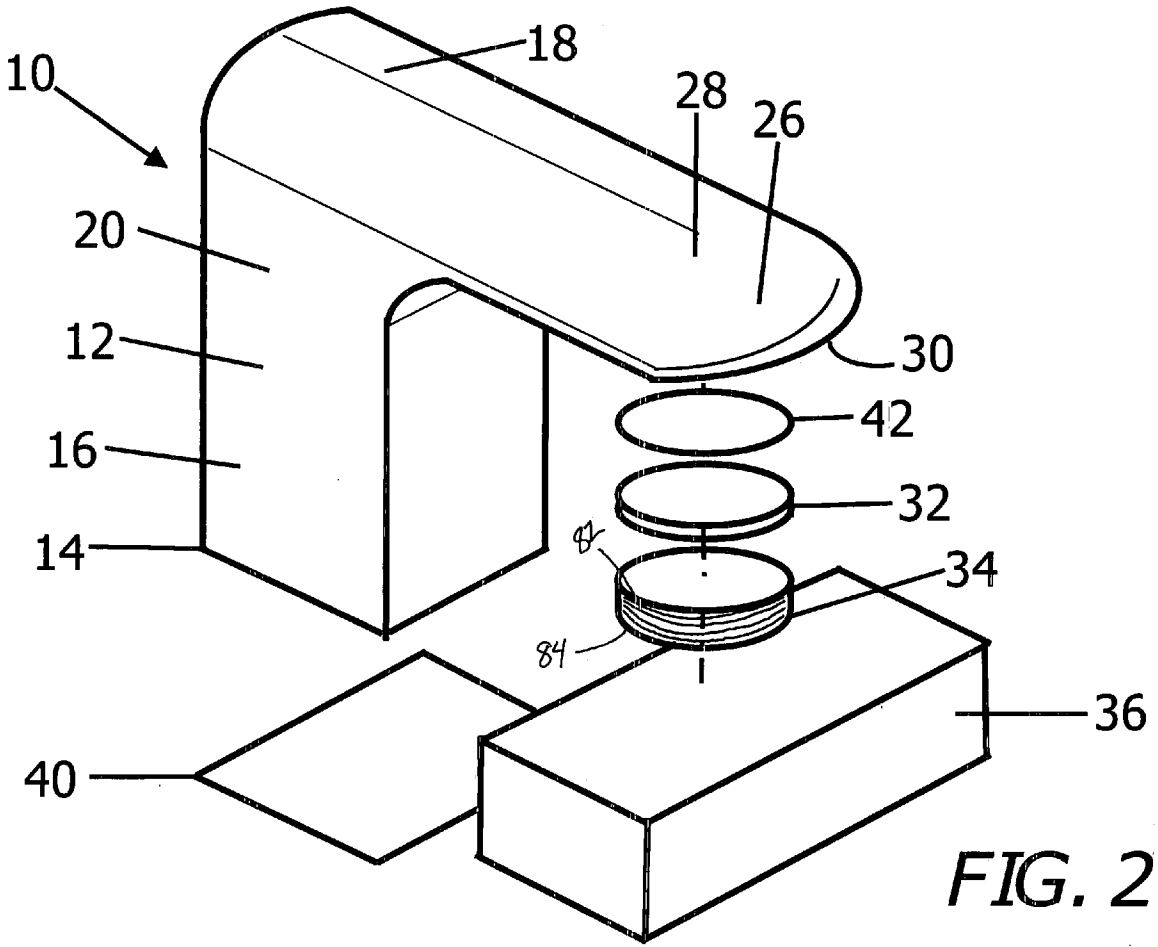
FIG. 2 is an exploded perspective view of the magnetic soap holder of FIG. 1.
Figure 3:
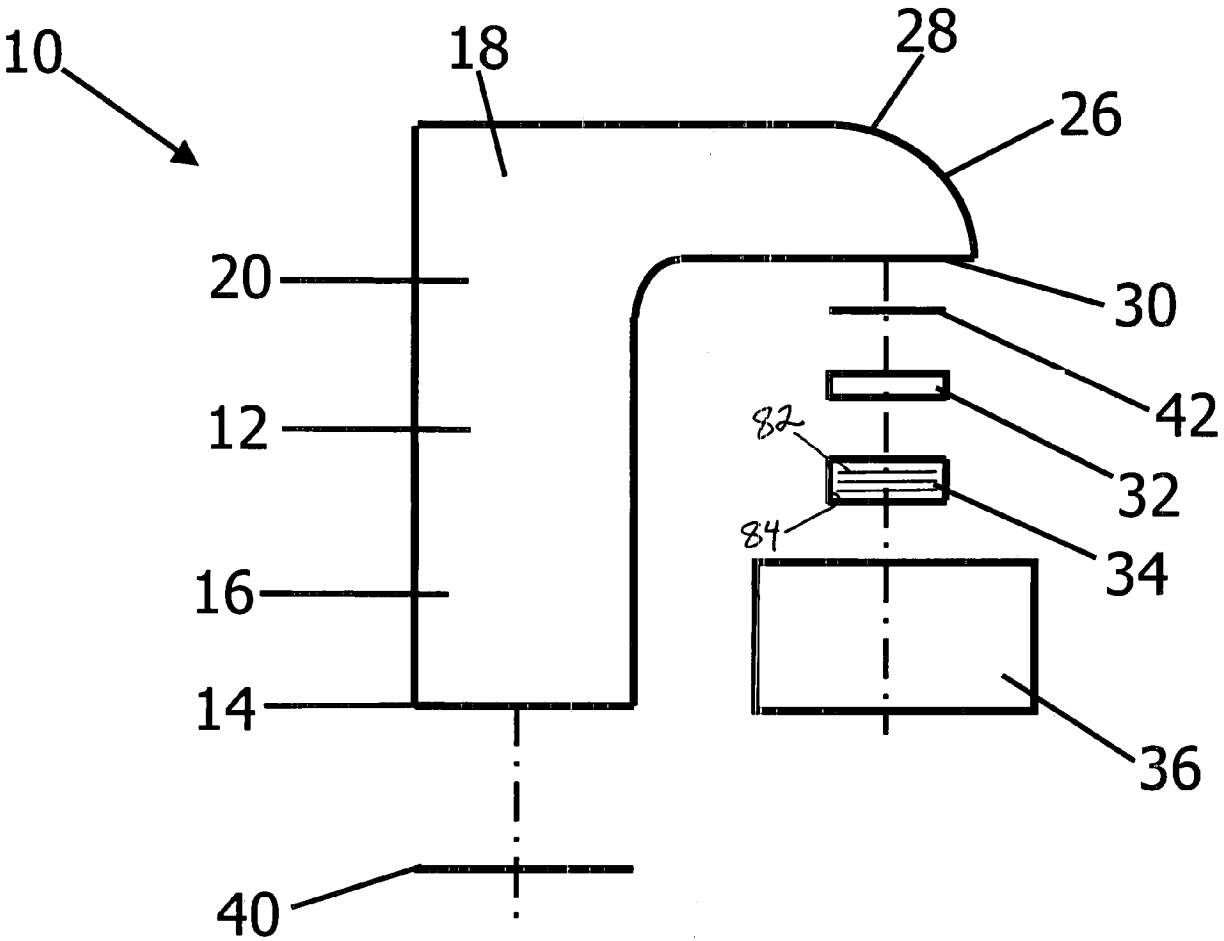
FIG. 3 is an exploded side view of the magnetic soap holder of FIG. 1.

FIGS. 2 and 3 show exploded views of the magnetic soap holder 10 illustrating the component parts of the present invention. The magnetic soap holder 10 preferably includes a substantially vertical portion 12 and a substantially horizontal portion 18. The substantially vertical portion 12 having a base 14 for attachment to a horizontal surface 22 surrounding a sink or tub 24. The base 14 is preferably mounted to the horizontal surface 22 with an adhesive 38. The mounting of the base 14 to the horizontal surface 22 may be permanent or may be releasable depending on the application. As an example, the adhesive may be a double coated foam tape, such as VHB No. 4946 manufactured by the 3M Company of St. Paul, Minn. One side of this tape is adhered to the base 10 during manufacturing of the holder, while the other side of the tape has a protective film 40 that is removed just prior to final installation by the consumer. The protective film 40 protects the adhesive 38 from contamination and is removed by the consumer just prior to final installation of the soap holder. The strength of the adhesive 38 allows the base 10 to be relatively compact so that it can fit on the edge of the majority of sinks and tubs. For example, the strength of the adhesive 38 is sufficient that the base 10 can be made with as little as 2,000 $mm^2$ (3.1 $in^2$) of surface area.

The magnetic soap holder 10 extends upward and outward from the base 14. The horizontal portion 18 includes a horizontal end portion 26 with a top surface 28 and a substantially flat bottom surface 30 to which a magnet 32 is attached. An example magnet 32 may be a 16 mm (0.63 in) diameter 2.5 mm (0.1 in) thick Nickel plated rare earth magnet provided by Adams Magnetic Products of Melrose Park, Ill. The magnet 32 can be attached to the bottom surface 30 of the horizontal end portion 26 with a fastener, such as a self-tapping screw, or an adhesive 42. Preferably, attachment of the magnet 32 to the bottom surface 30 of the horizontal end portion 26 of the magnetic soap holder 10 is made with an acrylic adhesive 42, such as Product 392 manufactured by Loctite of Rocky Hill, Conn.

A magnetic member 34 is preferably inserted into the bar of soap 36 for attraction to the magnet 32 attached to the bottom surface 30 of the horizontal end portion 26 of the magnetic soap holder 10. The magnetic member 34 is preferably made of a material that is both attracted to magnetic fields and inert to the caustic environment of a bar of soap into which it is inserted. A stainless steel alloy AL29-4C from Allegheny Ludlum of Skokie, Ill. has the required magnetic properties and can withstand the caustic environment of bar soap to be appropriate for use as material for the magnetic member of the present invention. A grooved pattern 82 is preferably formed on the inside surface 84 of the magnetic member 34 to increases the gripping capability and the frictional force between the soap and magnetic member.

Figure 4:
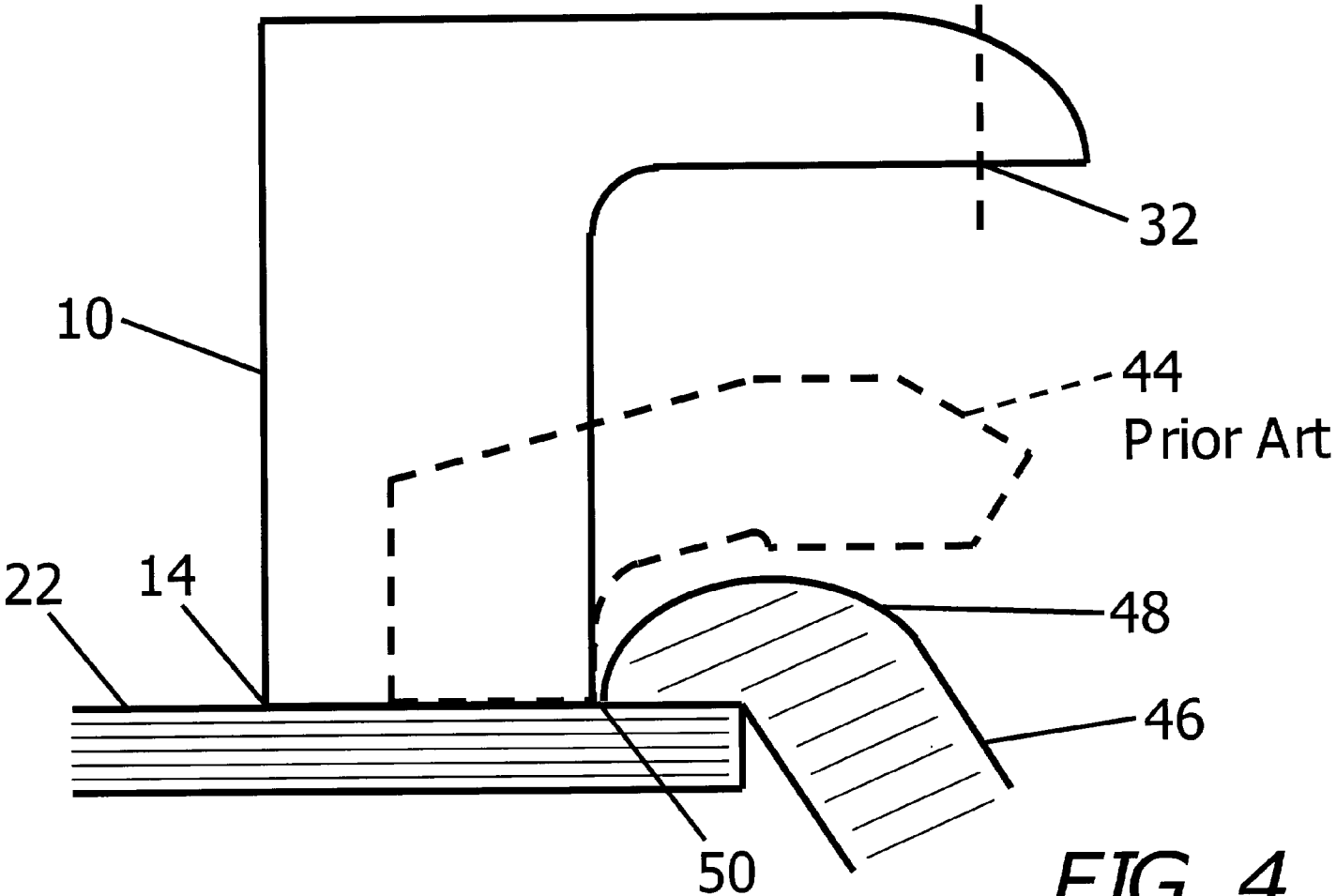
FIG. 4 is a side view of the magnetic soap holder of FIG. 1 in comparison with a prior art magnetic soap holder in relation to a drop-in sink.

Referring now to FIG. 4, the scale of the magnetic soap holder 10 of the present invention is compared with the scale of a prior art magnetic soap holder 44. Shown in profile is the prior art magnetic soap holder 44, which is not high enough nor deep enough to accommodate a bar of soap when mounted around a drop-in style sink 46. Therefore, the prior art magnetic soap holder 44 cannot be used with a drop-in style sink 46 that has a substantial lip 48 that can be over 50 mm (2.0 in) wide and 20 mm (0.8 in) high.

The Magnetic soap holder 10 of the present invention is high enough and deep enough to accommodate a bar of soap when mounted around a drop-in-style sink 46. Therefore, a bar of soap magnetically coupled to the soap holder 10 of the present invention would be high enough and extend into the sink basin far enough to overcome the substantial lip 48 of the drop-in style sink 46 of FIG. 4.

The magnetic soap holder 10 extends upwardly such that the magnet 32 is at least 65 mm (2.6 in) above the base 14. This accommodates any lip or edge 48 the sink or tub 46 might have and places the soap at a comfortable height for removal and replacement during use. The magnetic soap holder 10 also extends outwardly placing the center of the magnet 32 at least 43 mm (1.7 in) from the front 50 of the base 14.

Figure 5:
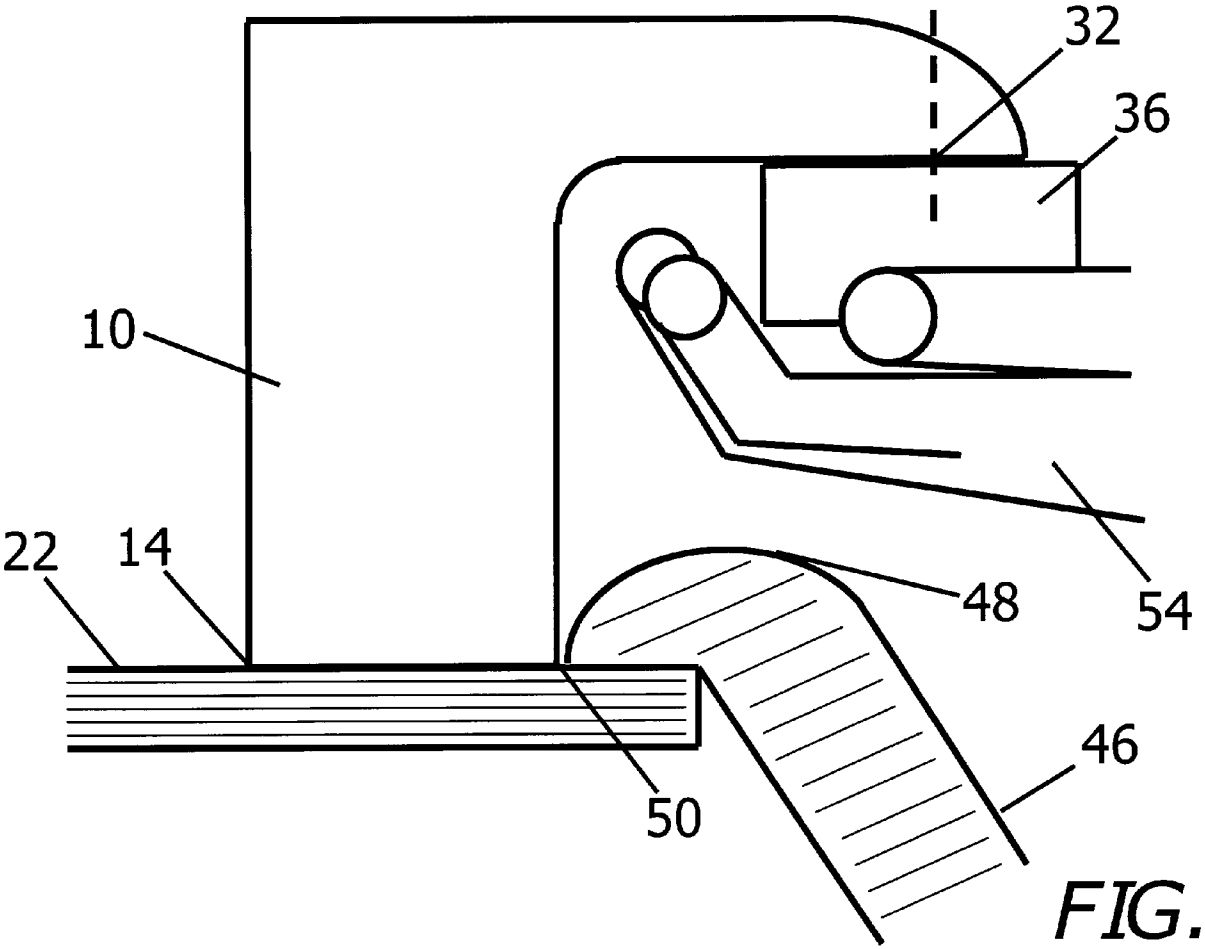
FIG. 5 is a side view of the magnetic soap holder of FIG. 1 showing a user's hand grasping the bar of soap.

FIG. 5 illustrates the usefulness and operation of the present invention. In FIG. 5, a user's hand 54 is grasping a bar of soap 36 magnetically coupled to the magnetic soap holder 10. The structure and geometry of the magnetic soap holder 10 places the bar of soap 36 at a high enough level that a user can comfortably cup their hand 54 under the bar of soap 36 to remove it for use and to replace it after use. Most bars of soap are about 25 mm (1.0 in) thick, and most peoples fingers are about 20 mm (0.8 in) thick. Therefore, the minimum total height necessary to overcome a 20 mm (0.8 in) sink lip 48 is about 65 mm (2.6 in). Of course, the height can be made higher or lower for cosmetic or other functional reasons.

Figures 6A, 6B:
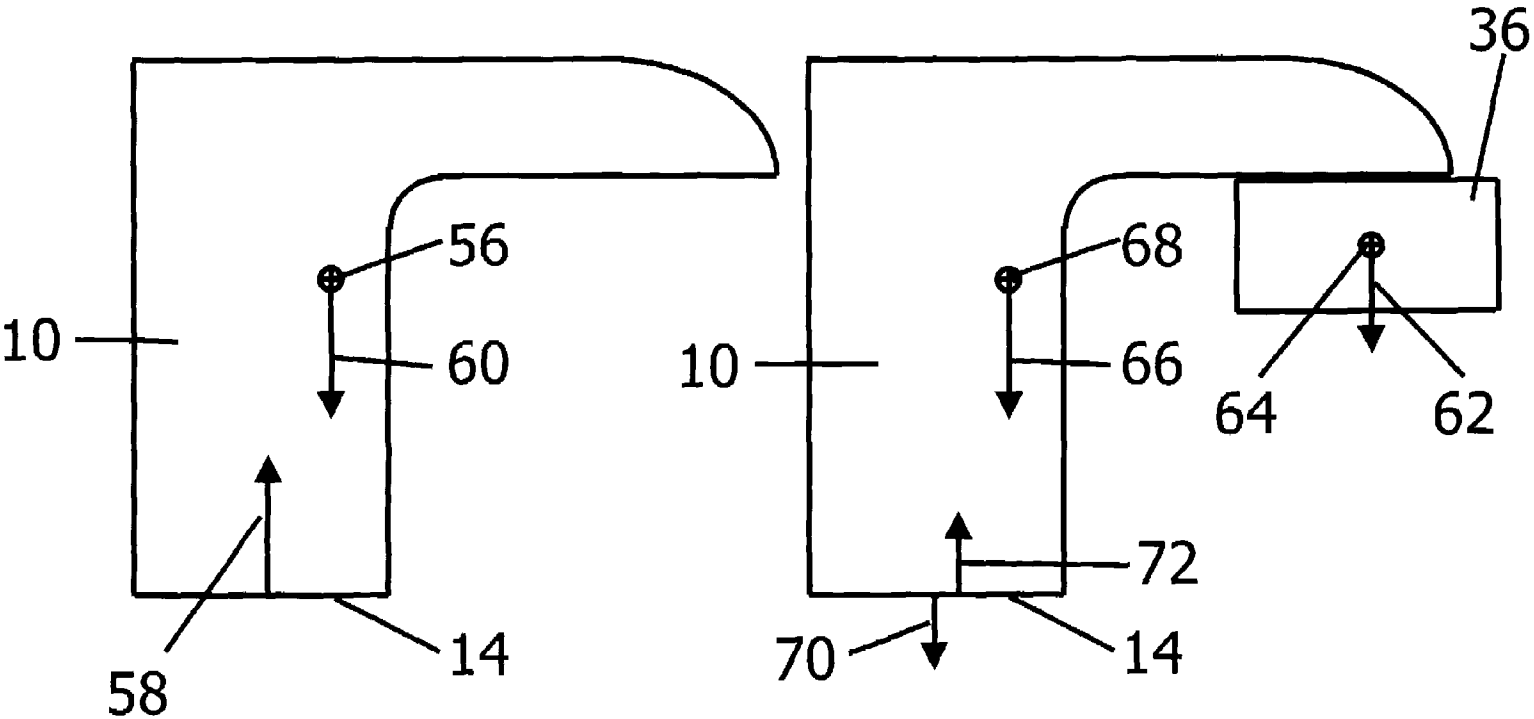
FIG. 6A is a side view of the magnetic soap holder of the present invention without a bar of soap removably attached thereto illustrating the approximate location of the center of gravity of the magnetic soap holder and the forces associated therewith.
FIG. 6B is a side view of the magnetic soap holder of the present invention with a bar of soap removably attached thereto illustrating the approximate locations of the center of gravity of the magnetic soap holder and bar of soap, and the forces associated therewith.

Referring now to FIGS. 6A and 6B, the magnetic soap holder 10 of the present invention is shown illustrating the various forces exerted on the soap holder 10 with and without a bar of soap 36 being attached to the holder. FIG. 6A shows the magnetic soap holder 10 without a bar of soap attached to the soap holder. The magnetic soap holder 10 is designed to be balanced and freestanding. The center of gravity 56 of the magnetic soap holder 10 is located above the base 14. The upward force 58 at the base 14 counteracts and balances the downward weight force 60 at the center of gravity 56. No net force is created, so the magnetic soap holder 10 of FIG. 6A is balanced and freestanding.

The retail display and installation of the magnetic soap holder is simplified because the soap holder is self-fixturing. A balanced and freestanding magnetic soap holder allows for the retail display of the soap holder without dependence on an adhesive. It also allows the purchaser and user to try different installation positions around a sink before final installation. Depending on ambient temperature, it can take over 24 hours for an adhesive to fully cure and achieve full bond strength. With the magnetic soap holder of the present invention, no attachment or external support is necessary during installation.

The prior art teaches that a magnetic soap holder should be as lightweight as possible to minimize the stress on the adhesive. Because the magnetic soap holder of the present invention is balanced, heavier and denser materials may be used for construction of the magnetic soap holder. Materials like metal, ceramic, glass, and cast resin are not only denser, but also more durable than injection molded plastic. The use of heavier and denser materials also reduces the mechanical shock of removing and replacing the soap on the magnet.

FIG. 6B shows the magnetic soap holder 10 with a bar of soap 36 attached to the soap holder. The magnetic soap holder 10 is designed to accommodate the forces exerted on the holder when the bar of soap 36 is magnetically coupled to the holder and is forcibly removed and replaced during use. The bar of soap 36 creates a downward weight force 62 at the soap's center of gravity 64. With the bar of soap 36 installed on the magnetic soap holder 10, the downward weight force 62 of the soap at the soap's center of gravity 64 and the downward weight force 66 at the holder's center of gravity 68 is more than the upward force 72 at the base 14. Therefore, an additional force 70 supplied by an adhesive (not shown) is required to balance the downward gravity forces 62, 66 of the soap 36 and magnetic soap holder 10 preventing the soap holder from falling over. Without the force 70 supplied by the adhesive (not shown), the holder would fall over. The combined center of gravity of the apparatus of FIG. 6B is located in the horizontal portion away from the base.

Figure 7:
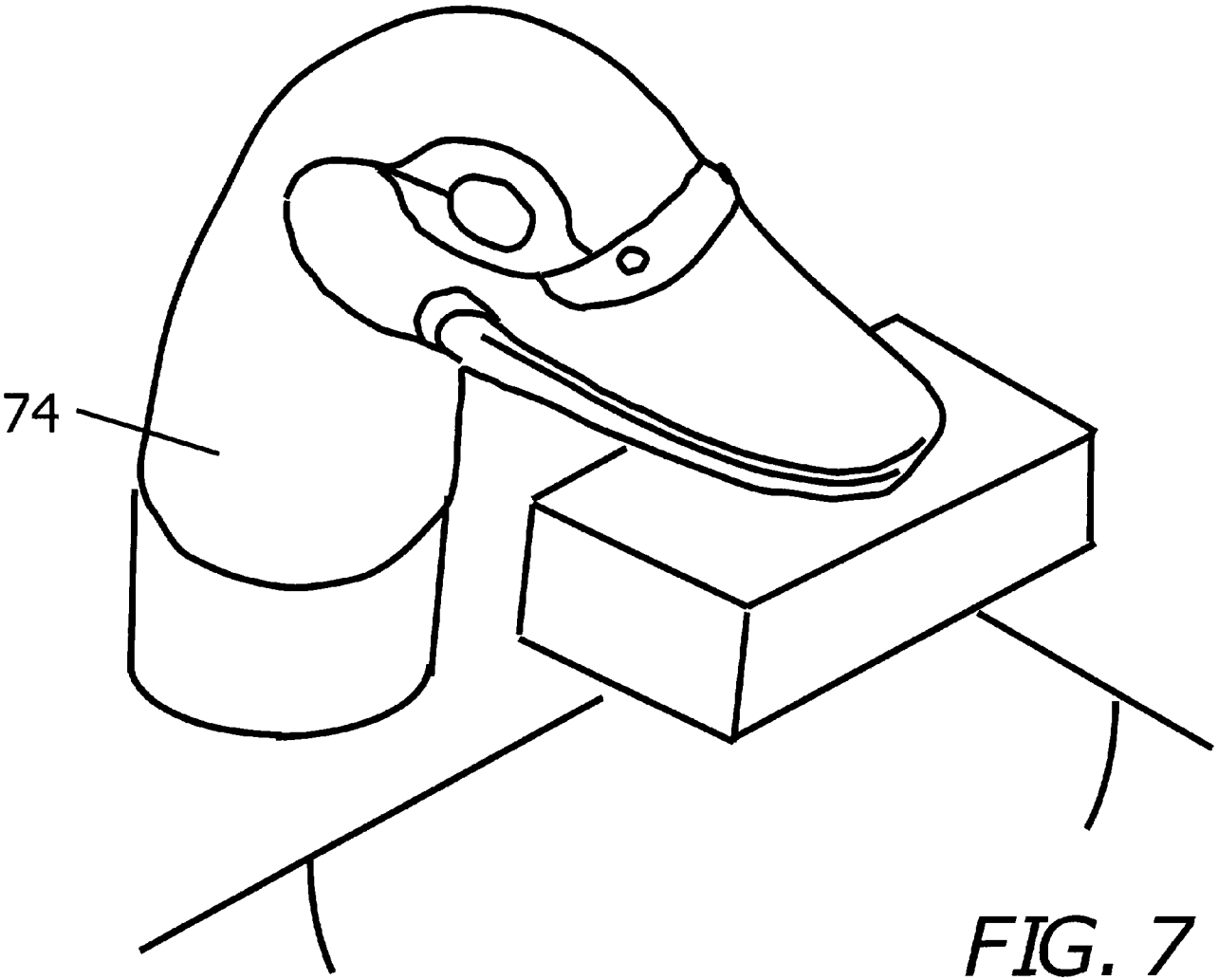
FIG. 7 is a perspective view of another embodiment of a magnetic soap holder of the present invention.

FIG. 7 shows another embodiment of a magnetic soap holder 74 in the shape of a duck head. The magnetic soap holder 74 is preferably cast in a mold using clay or porcelain slip. It is then fired in a kiln to make a ceramic. Further firing adds a vitreous glaze to make the surface durable and water repellent. The resulting soap holder 74 is both functional and an attractive work of art.

Figure 8:
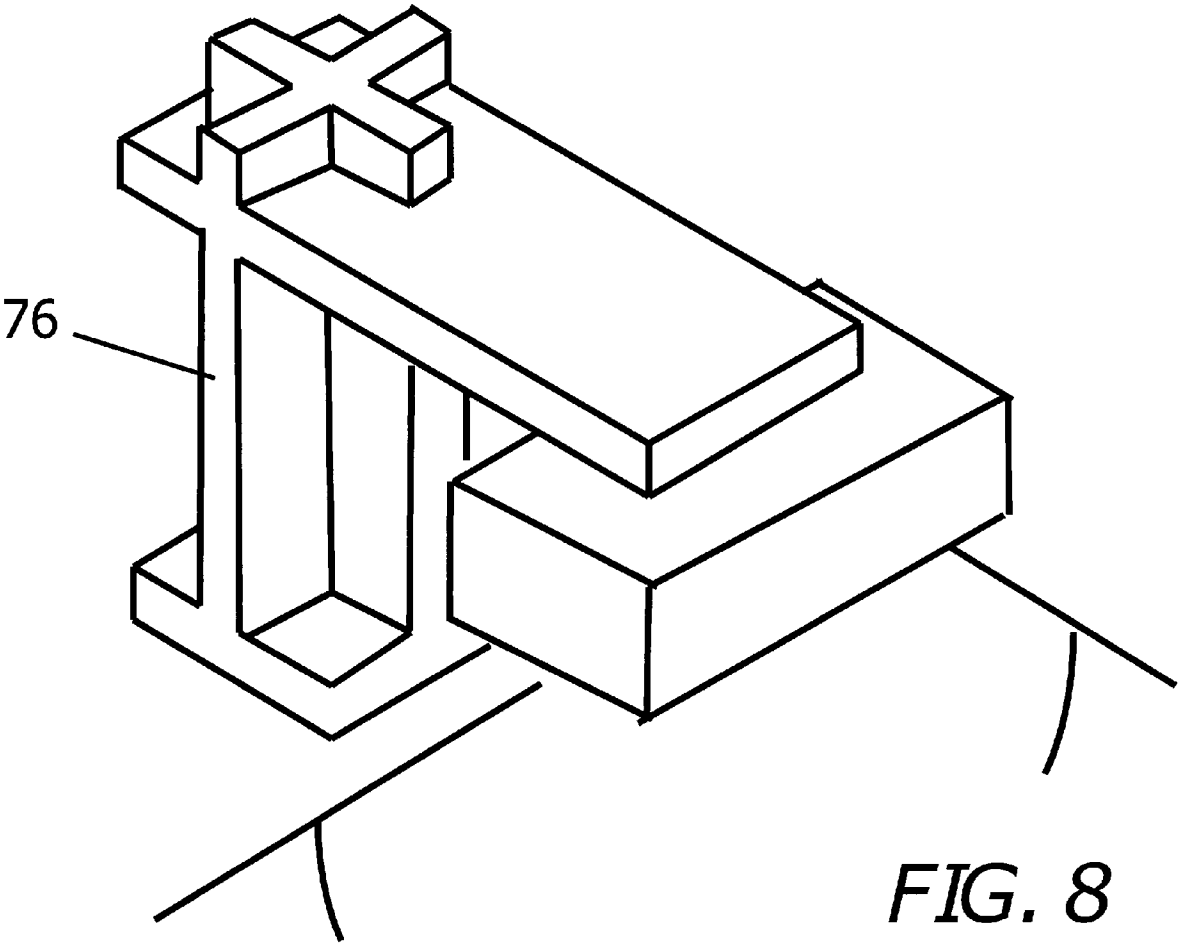
FIG. 8 is a perspective view of yet another embodiment of a magnetic soap holder of the present invention.

FIG. 8 illustrates yet another embodiment of a magnetic soap holder 76 having the appearance of an architectural form. Virtually any material can be used to manufacture such a soap holder. However, some materials may require protective coatings to make them waterproof The magnetic soap holder 76 can be cast as a single piece or made by attaching a plurality of separate plates together.

Figure 9:
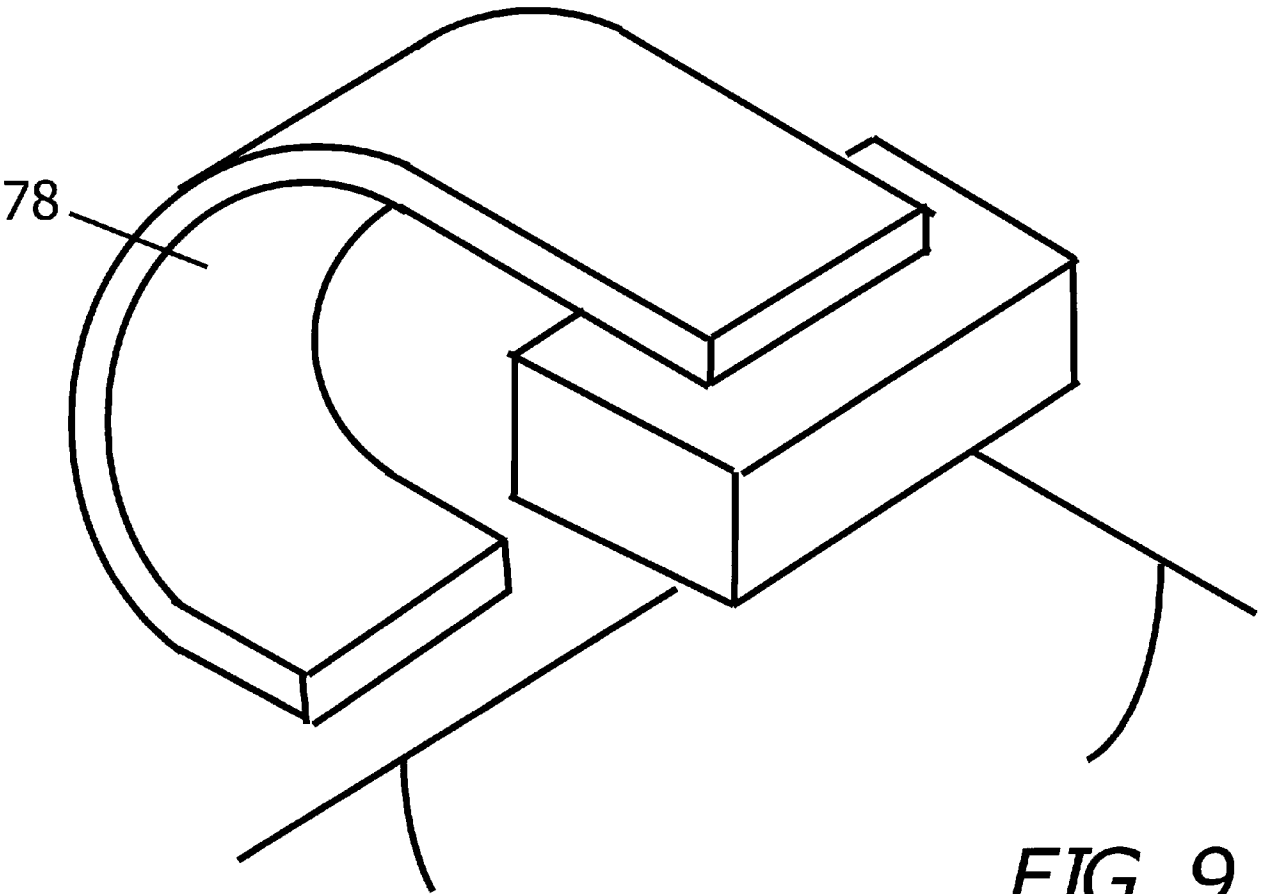
FIG. 9 is a perspective view of still yet another embodiment of a magnetic soap holder of the present invention.

FIG. 9 illustrates still yet another embodiment of a magnetic soap holder 78 in a contemporary style. A simple bent metal shape forms the magnetic soap holder 78 of FIG. 9. It naturally has the balance to be freestanding while minimizing the materials used for construction.

While the invention has been described with reference to preferred embodiments, it is to be understood that the invention is not intended to be limited to the specific embodiments set forth above. It is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

For example, other materials or combinations of materials with similar properties to those described could be substituted for the holder construction. Horizontal mounting of the holder could be integrated into the fabrication of either the sink or counter top. Additional features like illumination or sound generation could also be built-in as well.

We claim:

1. A magnetic soap holder, comprising:

a substantially vertical portion having a base horizontally mountable on a substantially flat surface, the base having a free end and a plurality of sides and a front edge at one side of the base, the magnetic soap holder having a center of gravity located directly above the base within the substantially vertical portion extending upwardly from the base, allowing the magnetic soap holder to be freestanding on its base, substantially the vertical portion having a plurality of vertical side faces, the vertical side faces being planar with the sides of the base;

a substantially horizontal portion extending upwardly and outwardly from the vertical portion, the horizontal portion having a horizontal end portion with a top surface and a substantially flat bottom surface, the horizontal end portion extending horizontally and outwardly to a distance past at least one side of the base, at least one vertical side face of the substantially vertical portion and the front edge of the base, so that the horizontal end portion is not located directly above and is not planar with the base; and a magnet mounted to the bottom surface of the horizontal end portion.

2. The magnetic soap holder of claim 1, wherein the magnetic soap holder is formed of rigid materials.

3. The magnetic soap holder of claim 2, wherein the rigid material is a ceramic material.

4. The magnetic soap holder of claim 3, wherein the ceramic material is a hollow porcelain ceramic.

5. The magnetic soap holder of claim 2, wherein the rigid material is a metal material.

6. The magnetic soap holder of claim 2, wherein the rigid material is a wooden material.

7. The magnetic soap holder of claim 2, wherein the rigid material is a glass material.

8. The magnetic soap holder of claim 2, wherein the rigid material is a cast resin material.

9. The magnetic soap holder of claim 1, further comprising an adhesive for mounting the base to a substantially flat surface.

10. The magnetic soap holder of claim 1, further comprising an adhesive for attaching the magnet to the bottom surface of the horizontal end portion.

* * * * *